United States Patent [19]

Chapuis et al.

[11] 4,239,979

[45] Dec. 16, 1980

[54] MEMBRANE CONTACTOR

[75] Inventors: Maurice Chapuis, Sayat; Jean-Yves Machat, Clermont-Ferrand, both of France

[73] Assignee: Compagnie Generale des Etablissements Michelin, Clermont-Ferrand, France

[21] Appl. No.: 964,661

[22] Filed: Nov. 29, 1978

[30] Foreign Application Priority Data

May 12, 1977 [FR] France ..... 77 36796
Oct. 23, 1978 [FR] France ..... 78 30273

[51] Int. Cl.[3] ..... H01H 35/34

[52] U.S. Cl. ..... 307/118; 307/144; 200/83 N; 200/83 R

[58] Field of Search ..... 307/118, 144; 200/83 N, 200/83 T, 83 R, 83 S

[56] References Cited

U.S. PATENT DOCUMENTS

| | | | |
|---|---|---|---|
| 2,111,168 | 3/1938 | Chansor | 200/83 |
| 2,260,636 | 10/1941 | Neff | 200/83 N |
| 2,817,727 | 12/1957 | Schmeling | 200/83 R |
| 2,883,194 | 4/1959 | Bogner et al. | 200/83 N X |
| 3,093,716 | 6/1963 | Horwitz | 200/83 N |
| 4,038,506 | 7/1977 | Filip | 200/83 J |

FOREIGN PATENT DOCUMENTS 946771 1/1964 United Kingdom .

*Primary Examiner*—George H. Miller, Jr.
*Assistant Examiner*—James L. Dwyer
*Attorney, Agent, or Firm*—Brumbaugh, Graves, Donohue & Raymond

[57] ABSTRACT

Contactor comprising at least two fixed studs, at least one movable stud capable of making or breaking an electric contact between the two fixed studs, and at least one membrane which can deform under the action of a fluid. The movable stud is fastened to the membrane in such a manner that the movable stud is isolated from the two fixed studs in position of rest. The contactor is characterized by the fact that the membrane comprises the following two parts:

(a) at least one substantially nondeformable base to which the movable stud is fastened; and (b) flanks which are elastic with respect to the base and firmly attached to the base, the deformation of the membrane being obtained substantially solely by stretching of the flanks, this deformation causing a displacement of the base and therefore a displacement of the movable stud.

16 Claims, 7 Drawing Figures

MEMBRANE CONTACTOR

This invention relates to contactors. By "contactors" there are understood apparatus intended to effect, whenever desired, the opening or closing of an electric circuit, the movable contact elements of these apparatus having only one mechanical position of rest which corresponds to the opening of the circuit. Such a definition is to be found, for instance, in the book "Electricité Appliquée" (Applied Electricity) by P. Heiny, in the collection "Techniques et Normalisation," Paris, Librairie Delagrave, 1972, page 72.

These contactors comprise at least one movable stud which makes it possible to make or break an electric contact between two fixed studs, each connected, for instance, to a source of electric current which may possibly be the same for the two stationary studs.

The current which passes between the stationary studs before the breaking of contact may either be of substantial amperage or of low or zero amperage, the contactors in this latter case being known as "disconnectors."

These contactors may be completely mechanical and/or electromagnetic, the force necessary for the movement of the movable stud being produced by means of levers, springs, or electromagnets.

These contactors may furthermore be placed in action by the pressure of a fluid acting on a deformable membrane, this pressure being then transmitted to the movable stud via mechanical and/or electromagnetic devices.

These two types of known contactors result in installations which are relatively heavy and costly, particularly when it is desired to effect simultaneously the making or breaking of electric contacts between more than two fixed studs. Furthermore, when the number of fixed studs becomes high, the production of contactors corresponding to these two types becomes practically impossible as a result of the techincal problems which must be solved, which reside in particular in the simultaneity of the movements of the movable studs and the maintaining of the contact resistances within reasonable limits.

It is known to establish electric detectors of pressure variations in pneumatic tires in the manner that these detectors comprise an elastic element bearing a movable electric contact. On such detector is, for instance, described in the French Patent Application published under No. 2,308,518. In this detector, the movable electric contact fastened to an elastic membrane is intended to make contact with a fixed electric contact; these two contacts being each connected to a terminal of an electric data transmitting circuit of which they constitute the on and off elements. These detectors are not adapted to the production of contactors which permit the opening or closing of an electric circuit when there are more than two terminals.

British Pat. No. 946,771 and U.S. Pat. No. 3,093,716 both describe an electric contactor having a flexible membrane. The securing of the membrane is effected by clamping the circular periphery of the membrane between two stationary parts. At rest, the free faces of the membrane have substantially flat and circular shapes. One of these faces is in contact with an insulating disk on which a movable stud is fastened and against which a spring acts. The other face of the membrane is, when at rest, in contact with a support. When the pressure of a fluid acts on the face of the membrane opposite the insulating disk, the membrane moves away from the support causing the compressing of the spring and contact between the movable stud and two fixed studs.

In these contactors, the membrane works in particular in flexure, which in the long run results in deterioration of the membrane and deformation of the disk so that the electric contacts are no longer assured. Moreover, these contactors are not well suited for the use of several movable studs fastened on the same membrane.

The object of the invention is to provide contactors which are free of the above-mentioned drawbacks.

Accordingly, the contactor in accordance with the invention, which has at least two fixed studs, at least one movable stud capable of making or breaking an electric contact between the two fixed studs, and at least one membrane which can deform under the action of a fluid, the movable stud being fastened to the membrane in such a manner that the movable stud is isolated from the two fixed studs in position of rest, is characterized by the fact that the membrane comprises the following two parts:

(a) at least one substantially nondeformable base to which the movable stud is fastened; and (b) flanks which are elastic with respect to the base and firmly attached to the base, the deformation of the membrane being obtained substantially solely by stretching of the flanks, this deformation causing a displacement of the base and therefore a displacement of the movable stud.

The invention also concerns the processes used in the contactors in accordance with the invention.

The invention will be readily understood on basis of the following illustrative examples and figures.

Among the figures of the drawing, all of which are schematic:

Figure 6:
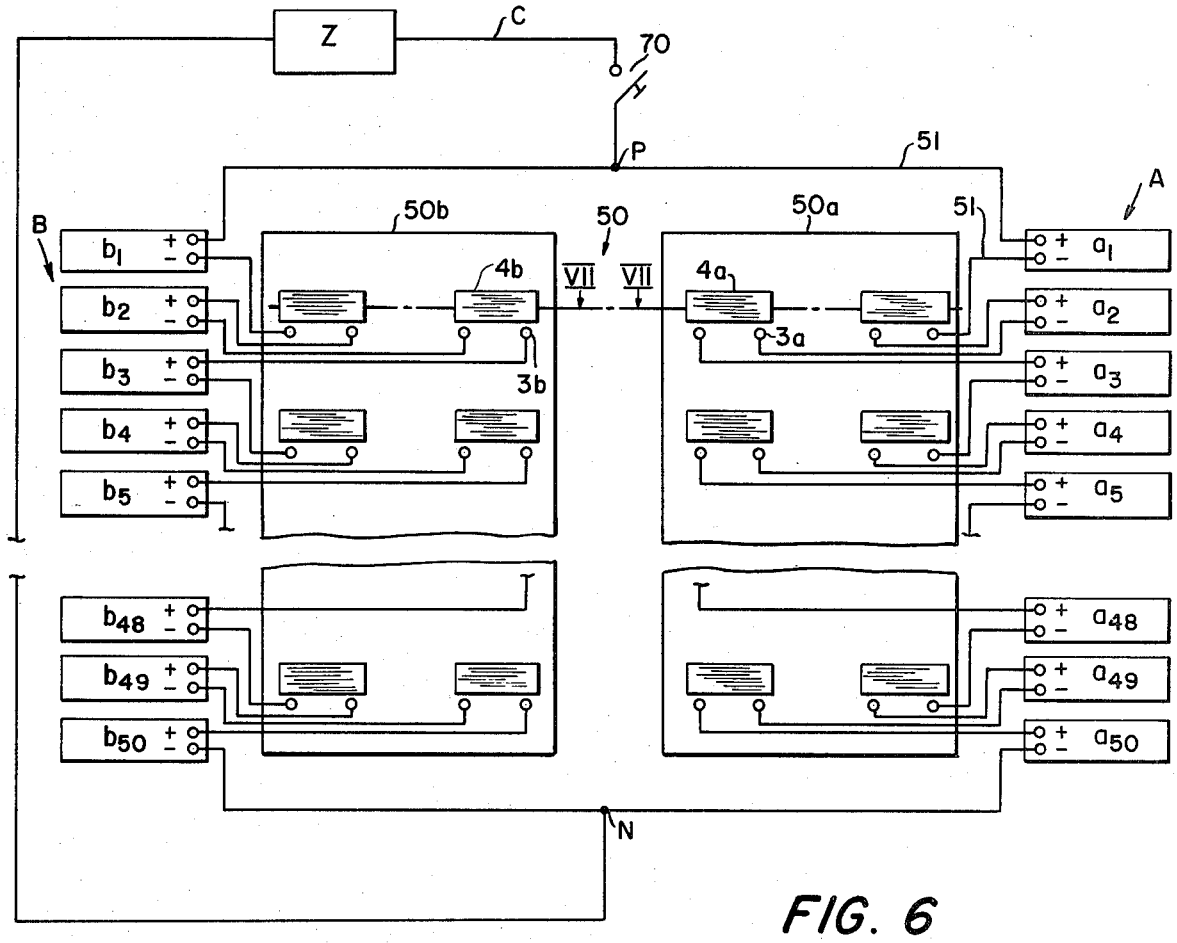
Figure 4:
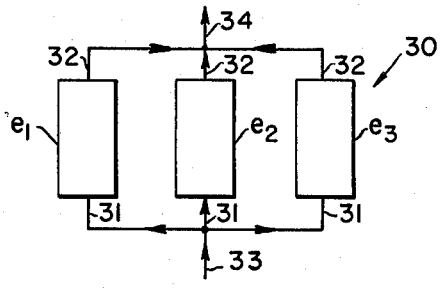
Figure 5:
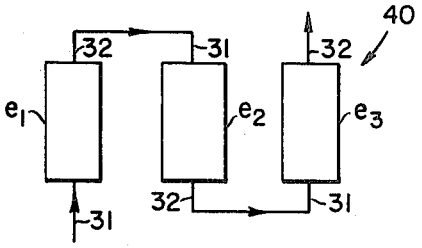
Figure 7:
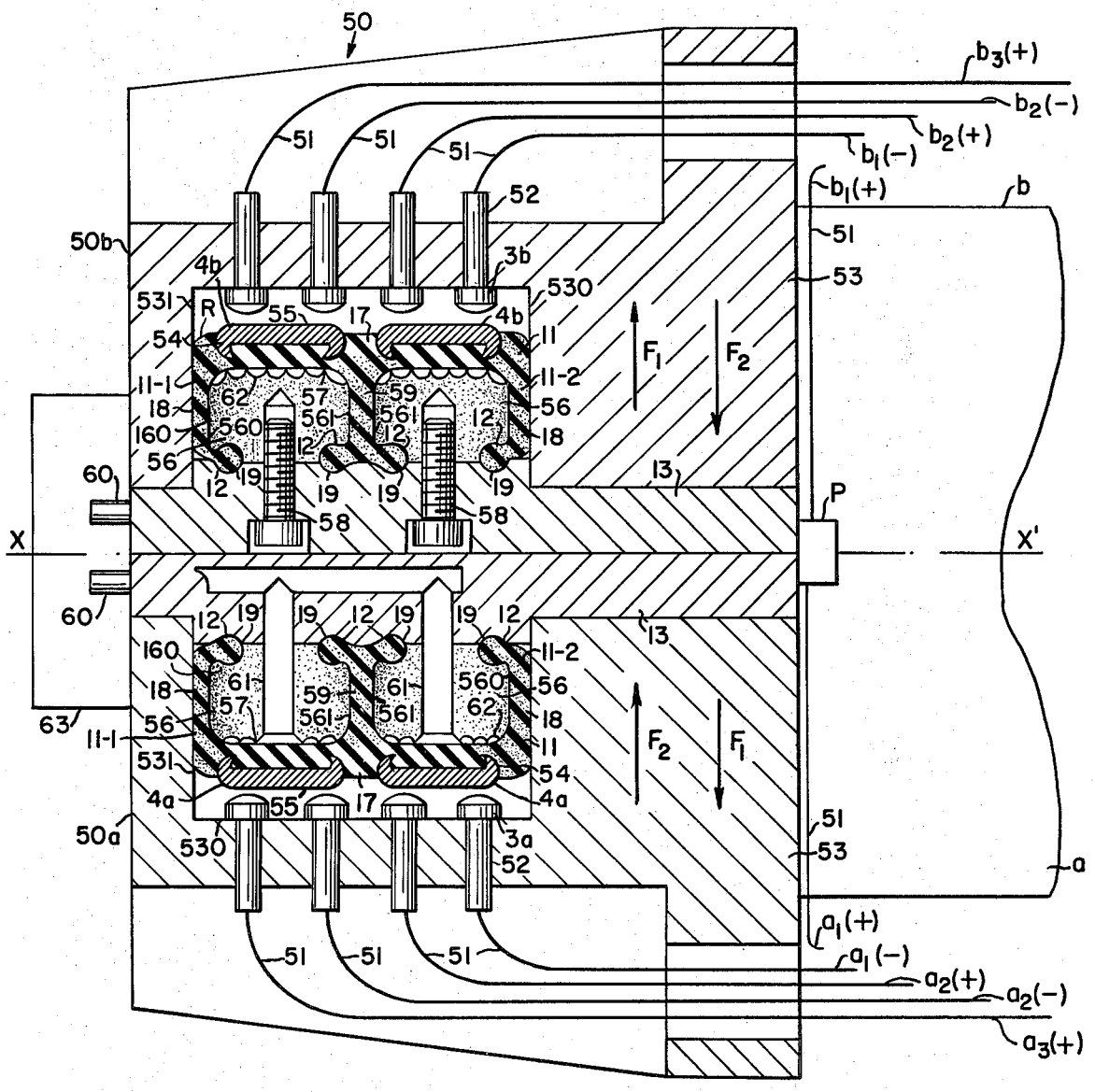

FIGS. 4 and 5 each represent a generator having three elements connected together by a common electrolyte, this connection being effected in parallel for the generator shown in FIG. 4 and in series for the generator shown in FIG. 5;

FIG. 6 represents an electric diagram of another contactor in accordance with the invention; and FIG. 7 represents, in horizontal section, the contactor whose diagram has been shown in FIG. 6.

Figure 1:
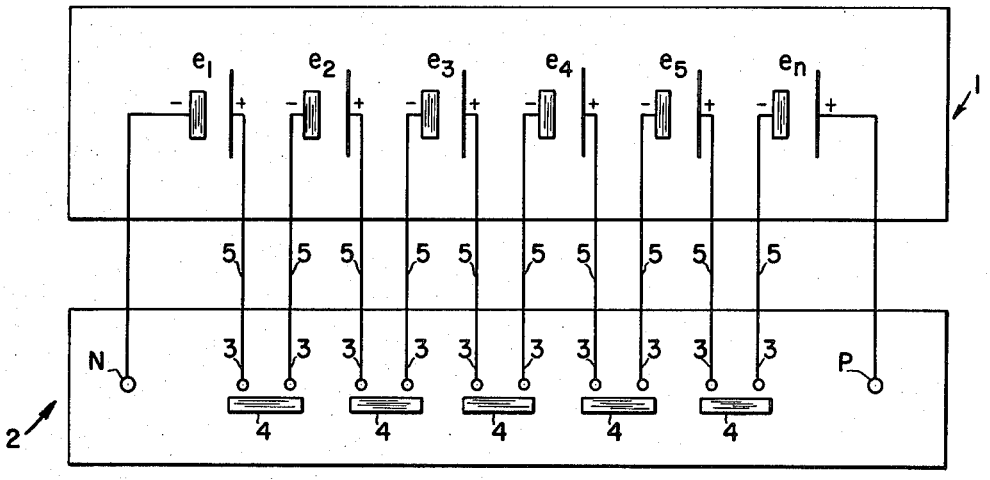
FIG. 1 (PRIOR ART)
FIG. 1 represents the electric diagram of an electric current generator comprising several elements connected to a prior art contactor.

FIG. 1 represents an electric current generator 1 associated with a contactor 2.

The generator 1 has n identical current-producing elements, these elements being marked from $e_1$ to $e_n$, n being, for instance, equal to 6 in the case of FIG. 1.

Each of these elements "$e_i$" (i varying from 1 to n) is capable of delivering the voltage u and the amperage I. The negative terminal of the element $e_1$ is connected to the terminal N of the contactor 2 and the positive terminal of the element $e_n$ is connected to the terminal P of the contactor 2. The other terminals of elements $e_1$ to $e_n$ are each connected to a fixed stud 3. A movable stud 4 is arranged opposite each pair of fixed studs 3 formed of a fixed stud connected to the positive terminal of one element and a fixed stud connected to the negative terminal of the following element (these terminals are not marked in order to keep the drawing simple). The contactor 2 therefore has 2(n−1) fixed studs and n−1 movable studs, that is to say in the case of FIG. 1, 10 fixed studs and 5 movable studs. Upon placing each movable stud in contact with the pair of corresponding fixed studs, the n elements $e_i$ are connected in series, the voltage U available at the terminals P and N being thus equal to nu and the amperage delivered by the genertor 1 into an electric discharge circuit (not shown) arranged between the terminals P and N being equal to I.

The prior art contactors mentioned above require as many mechanical or electromagnetic devices as there are movable studs 4, these mechanisms not being shown in FIG. 1.

Such a contactor 2 is therefore heavy, cumbersome, complicated and expensive in view of the number of movable studs. Furthermore, the simultaneity of the making or breaking of the contacts is difficult to realize between all the fixed and movable studs, which disturbs the operation of the generator 1. Moreover, it is difficult to obtain sufficient contact pressure between the fixed studs and the movable studs, which results in particularly high contact resistances. If "r" is such a resistance, the power lost during the operation of the generator is equal to $r\,(n-1)\,I^2$, that is to say it then represents an excessively large fraction of the power available.

It is furthermore difficult to predict the value of this resistance in view of the complex nature of the various devices of the contactor 2, so that this lost power may fluctuate, removing all reliability from the generator 1.

Figure 2:
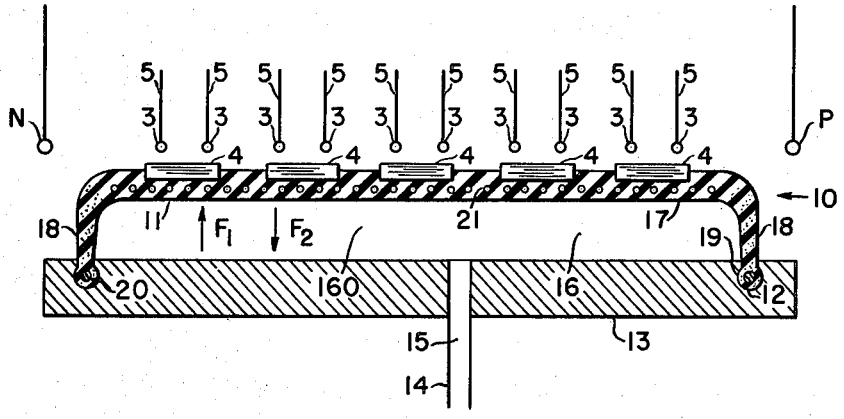
FIG. 2 represents a sectional view through a contactor in accordance with the invention.
Figure 3:
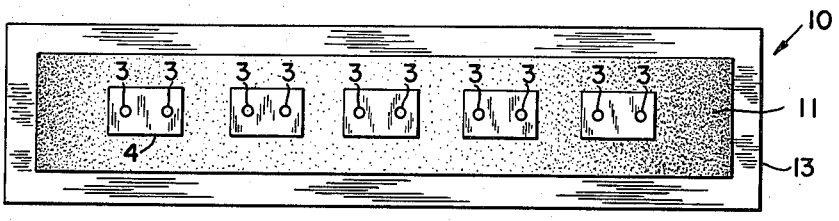
FIG. 3 represents the contactor of FIG. 2 in plan view.

FIGS. 2 to 3 represent a contactor 10 in accordance with the invention which makes it possible to avoid these drawbacks.

The contactor 10 has the deformable membrane 11, the periphery 12 of which is fastened in the support 13. The movable studs 4 of the contactor 10 are fastened to the membrane 11. These movable studs 4 have, for instance, the shape of bars and they are embedded in the membrane 11 in such a manner that the side thereof facing the fixed studs 3 of the contactor 10 is not covered by the membrane 11. A channel 14 passes through the support 13 and makes it possible either to introduce the liquid or gaseous fluid 15 into the chamber 16, defined by the membrane 11 and the support 13, or to evacuate all or part of the fluid 15 from said chamber 16. The introduction of the fluid 15 into the chamber 16 causes a deformation of the membrane 11, with displacement of the movable studs 4 towards the fixed studs 3 in such a manner that these movable studs 4 come into contact with the corresponding fixed studs 3, which then produces the electric contacts between these studs, the discharge circuit being thus closed.

Conversely, the total or partial evacuation of the fluid 15 causes a displacement of the movable studs 4 towards the support 13 with the opening of the electric contacts between the fixed and movable studs, that is to say the opening of the discharge circuit, the membrane 11 thus returning to a position of rest such that each movable stud 4 is isolated from the corresponding two fixed studs 3. Such an opening of the electric contacts can be obtained, for instance, by interrupting the admission of the fluid 15 into the chamber 16, as a result of the drop in pressure thus produced.

The fixed studs 3 and movable studs 4 can be made of any material which is a good conductor of electricity, such as, for instance, copper, possibly polished, gilded, silvered or cadmiumized.

The connection of the fixed studs 3 to the corresponding terminals of the elements $e_i$ can be effected with rigid or flexible conductors 5, these conductors 5 being, for instance, soldered or screwed to the fixed studs 3.

The membrane 11 is made of electrically nonconductive materials and the same is true preferably of the support 13. Such nonconductive materials, for instance, consist of plastic or elastomeric materials.

The membrane 11 is made in the manner that it is formed of three distinct parts of different operation: the periphery 12, the base 17, and the flanks 18 arranged between the base 17 and the periphery 12, these three parts being permanently connected.

These three parts 12, 17, 18 advantageously have the following characteristics:

the periphery 12 has at least in part the shape of a bead arranged in a corresponding groove 19 of the support 13 so as to permit a good hooking of the membrane 11 in the support 13; this periphery 12 in order to increase its rigidity has, for instance, a bead wire 20, that is to say a cable welded to its ends, this single or multi-strand cable being in particular of metal; it goes without saying that this arrangement is not limitative and the periphery 12 need not be provided with such a bead wire;

the flanks 18 are elastic;

the base 17 is of a generally flat rectangular and nondeformable shape; the base 17 forms with the flanks 18 a cavity 160, the cross section of which is of U shape (FIG. 2, 3).

The deformation of the membrane 11 with respect to its position of rest is due solely to the stretching of the flanks 18; the movable studs 4 fastened to the base 17 then have displacements which are parallel to each other, these displacements being parallel to the arrows $F_1$ and $F_2$ of opposite direction, these fixed direction arrows being practically perpendicular to the base 17 and substantially parallel to the flanks 18. The fixed studs 3 are then located at the same distance from the base 17; thus uniform contacts are assured for all the studs, with large and homogeneous contact pressures, as well as practically perfect simultaneity between the making or breaking of the electric contacts of all the studs; the rigidity of the base 17 can be obtained, for instance, by imparting to it a greater thickness than the rest of the membrane 11 and/or by reinforcing it with cables 21, for instance metal cables, of one or more strands, possibly forming one or more reinforcement plies, which cables can, for instance, be parallel to each other in each ply and diagonal to each other from one ply to the next; it goes without saying that this arrangement is not limitative, and the base 17 can be made of a rigid material which is free of cables and is of any thickness.

The flanks 18 are made of an elastic material, in particular an elastomeric material, the thickness of the flanks 18 being less than that of the base 17 if the elastic material is also used to produce the base 17.

The elasticity of the flanks 18 permits a particularly rapid break of the electric contacts due to the immediate expansion of the elastic material when the pressure of the fluid 15 drops in the chamber 16, this rapid break limiting the wear of the studs 3 and 4. The use of return devices other than the flanks is generally needless, which simplifies the construction of the contactor 10.

In addition to its role as means for securing the membrane 11 in the support 13, the periphery 12 also has the role of assuring the tightness of the assemly consisting of the membrane 11 and the support 13 with respect to the fluid 15.

The use of contactors in accordance with the invention is particularly useful with the use of electrochemical electric current generators. In fact, electrochemical reactions generally are carried out with low voltages so that it is necessary to connect in electrical series a large number of elements in order to have a generator capable of feeding an electric discharge circuit under a voltage of several tens of volts, as is in general necessary in installations capable of industrial application. The making or breaking of electric contacts between these elements must be particularly frequent when these elements are connected together by a common electrolyte, which connection can be effected in series or in parallel. Leakage current is then established, as a matter of fact, by this common electrolyte.

FIGS. 4 and 5 each represent, by way of example, a generator having elements connected together by a common electrolyte, these generators being thus subject to leakage currents. The generator 30 shown in FIG. 4 has three elements $e_1$, $e_2$, $e_3$. Each element is connected to an inlet conduit 31 and an outlet conduit 32, these conduits making it possible to create a flow of an electrolyte (not shown) in the corresponding element.

The inlet conduits 31 are connected to a common inlet conduit 33. The outlet conduits 32 are connected to a common outlet conduit 34. The common conduits 33 and 34 therefore make it possible to create a flow in parallel of the electrolyte in the elements $e_1$, $e_2$, $e_3$. The generator 40 shown in FIG. 5 differs from the generator 30 in that the three elements $e_1$, $e_2$, $e_3$ are traversed in series in this order by the electrolyte, that is to say the outlet conduit 32 of one element is connected to the inlet conduit 31 of the next element.

The common electrolyte feeds the anode or cathode compartments of the elements $e_1$, $e_2$, $e_3$ of the generators 30 and 40. It goes without saying that one can contemplate generators such that the anode and cathode compartments of these generators are fed in series or in parallel by circulation of electrolytes.

An electrolyte thus circulating in series or in parallel can be free of active material, for instance if said electrolyte is in contact with compact electrodes.

This electrolyte can, on the other hand, contain an active anode or cathode material. This active material contained in the electrolyte may be in dissolved condition, for instance a nitrogen or carbon fuel, in particular hydrazine or an alcohol. This active material may, on the other hand, be contained in the electrolyte in the form of particles, for instance particles formed at least in part of an anodic active metal, in particular zinc. Such generators with particles contained in an electrolyte are described for example in U.S. applications Ser. Nos. 821,759; 821,760; 821,761; 821,774; and 873,367.

In all generators comprising at least one common electrolyte, whether this electrolyte is or is not in circulation, the leakage currents of this electrolyte result either in a loss of active material or in a passivation or corrosion of the electrodes with which it is in contact.

These drawbacks make themselves evident essentially when the elements do not deliver current into the discharge circuits external to the generators. It is therefore necessary to break the electric contacts between the elements of the generators during these periods of stoppage and to reestablish these contacts when the generator delivers current.

Another type of use of the contactors is accordance with the invention is found, for instance, in photoelectric generators, particularly solar batteries, in which the large number of elements makes the making and breaking of electric contact between these elements particularly difficult.

FIG. 6 represents the electric diagram of the connection of 100 electric current generating elements, marked $a_1$ to $a_{50}$ and $b_1$ to $b_{50}$, to the contactor 50 of the invention, shown in FIG. 7. The contactor 50 has two parts 50*a* and 50*b* which are symmetrical with respect to the plane XX' which is, for instance, vertical. The part 50*a* permits the placing in electrical series of the elements $a_1$ to $a_{50}$ which thus constitute the module A, and the part 50*b* permits the placing in electric series of the elements $b_1$ to $b_{50}$ which thus constitute the module B, the modules A and B being connected electrically in parallel to the terminals P and N so as to constitute a single generator, the total power of these 100 elements being thus delivered into the electrical circuit C containing the discharge impedance Z and connected to the terminals P and N, these terminals being possibly fastened on the contactor 50.

The elements $a_1$ to $a_{50}$ are, for instance, arranged in the order one above the other; the element $a_1$ being the highest and the element $a_{50}$ the lowest. The same is true of the elements $b_1$ to $b_{50}$, the element $b_1$ being the highest and the element $b_{50}$ the lowest. The assembly of the elements $a_1$ to $a_{50}$ and the assembly of the elements $b_1$ to $b_{50}$ can form, for instance, two blocks a and b, respectively, corresponding to the modules A and B, arranged side by side and adjacent to the contactor 50, these blocks a and b being represented in part in FIG. 7.

The positive terminal of the element $a_1$ is connected to the terminal P and the negative terminal of the element $a_{50}$ is connected to the terminal N. The other positive and negative terminals of the elements $a_1$ to $a_{50}$ are connected to the fixed studs 3*a* of the part 50*a*. This connection is effected in such a manner that the fixed studs 3*a* corresponding to two poles of opposite sign of two successive elements constitute successive couples arranged in rows of two, located one above the other, going from top to bottom in the case of the junctions in the order of the elements $a_1$ to $a_{50}$.

Opposite each pair of fixed studs 3*a* there is arranged a movable stud 4*a* of the part 50*a*. The positive and negative poles of the elements $b_1$ to $b_{50}$ are connected, in a manner identical to the previously described arrangement, to the poles P, N and to the fixed studs 3*b* of the part 50*b*, a movable stud 4*b* of the part 50*b* being arranged opposite each pair of fixed studs 3*b*. All these connections are effected with flexible or rigid electric conductors 51. For clarity in the drawing, the fixed studs 3*a* and 3*b* have been shown below the corresponding movable studs 4*a* or 4*b* in FIG. 6, while in actual fact they are at the same level.

The arrangement and operation of each part 50*a* and 50*b* are as follows. The membrane 11, made for instance of natural rubber, is formed of two elementary membranes 11-1 and 11-2 placed back to back, which are of practically identical shape, each of them having a periphery 12 at least in part in the shape of a bead disposed in the corresponding groove 19 of the support 13, which is, for instance, made of plastic. The vertical base 17 common to the membranes 11-1 and 11-2 has the movable vertical studs 4*a* or 4*b*. Each stud 4*a* or 4*b* is arranged opposite a horizontal pair of fixed studs 3*a* or 3*b*, these fixed studs being each connected to a rod 52 screwed into an insulating frame 53, for instance of plastic, which frame can withstand a temperature sufficient to permit the soldering of the conductor wires 51 to the corresponding rods 52. The horizontal section 7 shows only four fixed studs 3*a*, four fixed studs 3*b*, two movable studs 4*a*, and two movable studs 4*b*, this section 7 being taken at the level VII—VII indicated in the electric diagram of FIG. 6.

The movable studs 4*a* and 4*b* shown each correspond to an elementary membrane 11-1 or 11-2. The references a1+, a1−, a2+, a2−, a3+, on the one hand, and b1+, b1−, b2+, b2−, b3+, on the other hand, indicate each the element and the sign of the pole (not shown in FIG. 7) from which each of the conductors 51 shown comes, the conductors 51 which come from the positive poles of the elements $a_1$ and $b_1$ being connected to the pole P common to the blocks a and b and fastened on the supports 13 of the contactor 50, the other conductors 51 being each connected to one of the fixed studs 3*a* and 3*b* shown.

The fixed and movable studs are made of polished and silvered copper. The fixed studs 3*a* and 3*b* have the shape of portions of a sphere in order to improve the quality of the electrical connection. The movable studs 4*a* and 4*b* have the shape of small bars fastened by overmolding in the membranes 11 before heat vulcanization. These bars have protrusions or spurs 54 which further improve their attachment as a result of a dovetail anchoring. The face 55 of each bar 4*a* or 4*b* arranged opposite the corresponding studs 3*a* or 3*b* is practically flat and not covered by the correspondng membrane. Each elementary membrane 11-1 or 11-2 is held in position on the inside by a membrane holder 56, for instance of plastic. This membrane holder 56 has protuberances 57 forming, for instance, channels on the side thereof facing the corresponding base 17.

The screws 58 pass through the supports 13 and penetrate into the membrane holders 56 so as to permit the fastening of each membrane holder to the corresponding support 13 and in such a manner as to be able to regulate the position of said membrane holder so that the corresponding base 17 rests against the protuberances 57 when the electric contacts between the fixed and movable studs are broken, that is to say when the corresponding membrane is at rest, the electric circuit C being then open.

For clarity in the drawing, only two screws 58 corresponding to the part 50*b* have been shown. The membrane 11 is arranged in a cavity 530 of the frame 53. Each outer flank 18 of this membrane 11 is in contact, on the one hand, towards the outside of the membrane 11, with a face 531 of the cavity 530 and, on the other hand, towards the inside of the membrane 11, with a face 560 of a membrane holder 56. The inner flank 59, which is vertical and common to the elementary membranes 11.1 and 11.2 of this membrane 11, is in contact with the faces 561 of the corresponding membrane holders 56. The flanks 18, 59, and the faces 531, 560, 561, are oriented practically perpendicular to the orientation of the base 17, which is practically vertical. The membrane holders 56 are thus arranged at least in part in the cavities 160 defined by the base 17 and the flanks 18, 59, this base 17 and these flanks 18, 59 having each a practically flat general shape, as well as the faces 531, 560, 561. A conduit 60 penetrates into each support 13 and branches to form two conduits 61, each penetrating into the support 13 and passing through a membrane holder 56. These conduits 60 and 61 serve for the introduction and evacuation of a fluid between each membrane holder 56 and the corresponding elementary membrane 11.1, 11.2. Each conduit 61 opens into a free space 62 arranged between two adjacent protuberances 57 and the base 17 when the corresponding membrane 11 is at rest.

For clarity in the drawing, the conduits 61 relating to the part 50*b* have not been shown. It is clear that there may possibly be more than one conduit 60 per part 50*a* or 50*b* and several conduits 61 for a given membrane holder 56, so as to balance the pressures.

The characteristics of each membrane 11 are for instance as follows:

the base 17 has on the outside the shape of a rectangle the vertical length of which is about 380 mm and the horizontal width about 45 mm, the thickness of this base being about 5 mm; the bars 4*a* or 4*b* are fastened to this rectangle which is opposite the inner flank 5*g*;

the flanks 18, 59 each has a thickness of about 1.5 mm and a height of about 10 mm, this height being measured perpendicularly to the base 17; the four flanks 18 each connect to one side of the rectangle defined by the base 17;

the flanks 18 and 59 are connected to each other and to the base 17 by roundings R so as to limit the risk of tearing upon movements of the membrane 11;

the membrane 11 is made of natural rubber having a 100% elongation modulus of about 0.6 megapascal (i.e., about 60 g/mm$^2$); the membrane 11 is molded as one piece.

The membrane 11 being at rest, the fluid, for instance air, is introduced through the conduit 60 and 61 between the membrane 11 and the corresponding membrane holders 56, the pressure of the fluid being for instance on the order of 2 to 7 bars.

The membrane 11 then moves towards the facing fixed studs 3*a* or 3*b* in the direction of the corresponding arrow F1 of fixed orientation. The base 17 of this membrane 11 remains rigid, vertical, and parallel to itself during this displacement, the membrane 11 deforming solely by the stretching of its flanks 18 and 59 which remain guided during their movement by the faces 531 of the corresponding frame 53 and by the faces 560, 561 of the corresponding membrane holders 56. The movable studs 4*a* and 4*b* thus come into contact with the corresponding fixed studs 3*a* or 3*b*, which closes the electic circuit C. The opposite displacement of the membrane 11 takes place along the corresponding arrow F2, the direction of which is opposite that of the arrow F1 when the pressure of the fluid is interrupted, due to the elasticity of the flanks 18 and 59, the base 17 then coming back into contact with the protuberances 57. The presence of the membrane holders 56 makes it possible to limit the volume of fluid necessary for the displacement of the membrane 11, the fixed studs 3*a* and 3*b* being located at a slight distance from the corresponding movable stud 4*a* or 4*b* at rest, this distance being for instance on the order of 2 mm. The inertia of the contactor 50 is then low and its response time is very short, for instance on the order of 0.1 second. Furthermore, the consumption of fluid is low, for instance of the order of 30 cc per membrane 11 for each introduction of fluid. This arrangement furthermore has the advantage of permitting practically perfect simultaneity of the making or breaking of all the electric contacts between the fixed and movable studs despite the high number of fixed studs, equal to 196, and of movable studs, equal to 98, for the entire contactor 50.

It goes without saying that one can possibly have independent operation of each membrane 11 by providing independent fluid feeds or discharges for the different conduits 61. This solution may have the advantage of causing the modules A and B to operate independently.

The elements $a_1$ to $a_{50}$ and $b_1$ to $b_{50}$ can, for instance, be identical electrochemical elements the anode and/or cathode compartments of which are fed in series by at least one common electrolyte, the series feeding taking place in particular either for all the elements or in each of the two assemblies $a_1$ to $a_{50}$, on the one hand, and $b_1$ to $b_{50}$, on the other hand. The total voltage available at the terminals P and N is then equal to fifty times the voltage of each element, that is to say 50 volts if the voltage of each element is equal to 1 volt, and the total intensity of the current passing in the circuit C is equal to twice the intensity passing in each module A or B.

In another arrangement, the pairs of poles ai+, bi+, on the one hand, and ai−, bi−, on the other hand, can possibly each correspond to two outputs of the same polarity of one and the same cell (not shown), the elements ai and bi being taken two fictitious elements electrically equivalent to said cell. In this case, the modules A and B are merged and the total voltage available at the terminals P and N is equal to fifty times the voltage of said cell if the cells have the same voltage and the total intensity (amperage) of the circuit C is equal to that which flows in each of these cells.

This solution which consists in doubling the number of fixed and movable studs is equivalent to dividing by two the intensity of the current passing through these studs, which can facilitate the manufacture of the contactor 50 and decrease the wear of these studs.

It may be advantageous to have the contactor 50 operate with a low or zero current intensity upon the breaking of the contacts in order to limit the wear of the studs. For this purpose there is then used a device 70 which makes it possible to open or close the circuit C (FIG. 6), which device can for instance be a contactor in accordance with the invention.

The contactor 50 then breaks the contacts between the studs which it contains after the circuit C has been opened due to the device 70.

The contactor 50 operates in this case as a disconnector, the amperage passing through its studs before the opening of the contacts being then zero, if there are no leakage currents, or low, if there are leakage currents, since the intensity of these currents does not in general exceed 500 mA.

In order to avoid for the contactor 50 the risks of opening under load when it is used as disconnector, it is advisable to provide a safety device, indicated schematically by the block 63 in FIG. 7, this device 63 blocking the control of this contactor 50 as long as the elements $a_1$ to $a_{50}$ and $b_1$ to $b_{50}$ deliver current, this blocking being obtained for instance due to at least one valve arranged in each conduit 60.

The contactors in accordance with the invention can be used, for instance, on an electric vehicle, in particular with one or more installations similar to the one which has been shown in FIGS. 6 and 7. The source of fluid can then be a compressed air cylinder or a hydraulic tank associated with a pump.

Of course the invention is not limited to the embodiments described above, on basis of which one can contemplate other methods and embodiments without thereby going beyond the scope of the invention.

Thus, for instance, the invention covers the following embodiments:

the securing of the membrane can be effected by compressing the periphery or peripheries between two parts assembled by soldering or by nuts and bolts, at least one of said parts possibly having a recess; these parts can in particular be a frame 53 and a support 13;

one can contemplate membranes without fastening periphery; such a membrane, for instance, forms a cavity each of two opposite faces of which constitutes a base, these two bases being connected by the other faces constituting continuous flanks; in this case if one desires the fastening of the membrane to a support, it is possible to effect this fastening at isolated points of one or more flanks or on a portion of the surface of at least one flank;

in order to increase the rigidity of the base when it has a plurality of movable studs, the studs can be arranged alternately, for instance, staggered.

It goes without saying furthermore that the expression "fixed" as used above is relative, and the so-called "fixed" members of the contactors in accordance with the invention can possibly be movable themselves, for instance, when these contactors are used on vehicles.

What is claimed is:

1. Contactor comprising at least two fixed studs, at least one movable stud capable of making or breaking an electric contact between the two fixed studs, and at least one membrane which can deform under the action of a fluid, the movable stud being fastened to the membrane in such a manner that the movable stud is isolated from the two fixed studs in position of rest, characterized by the following features:

(a) the membrane comprises the following two parts: at least one substantially nondeformable base and to which the movable stud is fastened; and flanks which are elastic with respect to the base and firmly attached to the base, the deformation of the membrane being obtained substantially solely by stretching of the flanks, this deformation causing a displacement of the base and therefore a displacement of the movable stud;

(b) the return of the membrane to its position of rest being obtained substantially solely by the elasticity of the flanks;

(c) the base and the flanks define at least one cavity in which is arranged at least in part a membrane holder; the corresponding fixed and movable studs being located on the outside of this cavity;

(d) means are provided for introducing the fluid between the membrane and the membrane holder or for evacuating the fluid from between the membrane and the membrane holder;

(e) the base being in contact with the membrane holder only in its position of rest; and (f) the membrane holder being capable of guiding the flanks during the deformation of the membrane.

2. Contactor according to claim 1, characterized by the fact that the membrane holder has protuberances against which the base lies at rest and that said means comprise at least one conduit opening into a free space, in the position of rest, between two adjacent protuberances and the base.

3. Contactor according to claim 1 or claim 2, characterized by the fact that it comprises means for regulating the position of the membrane holder in the membrane.

4. Contactor according to claim 1, characterized by the fact that the membrane is arranged in a cavity of a frame capable of guiding at least one flank during the deformation of the membrane.

5. Contactor according to claim 1, characterized by the fact that the base and the flanks have each a general practically flat shape, the flanks being practically perpendicular to the base.

6. Contactor according to claim 1, characterized by the fact that the membrane has at least one fixed fastening periphery, said periphery or peripheries being permanently connected to the flanks.

7. Contactor according to claim 6, characterized by the fact that said periphery has at least in part the shape of a bead disposed in a support.

8. Contactor according to claim 1, characterized by the fact that the movable stud has the shape of a bar embedded in the base, the side thereof which faces the fixed studs not being covered by the membrane.

9. Contactor according to claim 8, characterized by the fact that the bar has spurs anchored in the membrane.

10. Contactor according to claim 1, characterized by the fact that the membrane has at least two elementary membranes connected by a common inner flank.

11. Contactor according to claim 1, characterized by the fact that it comprises at least two membranes arranged symmetrically with respect to a plane.

12. Contactor according to claim 1, characterized by the fact that the base has on its outside a rectangular shape.

13. Contactor according to claim 1, characterized by the fact that the base and/or the fastening periphery have at least one stiffening cable.

14. Contactor according to claim 1, characterized by the fact that it is a disconnector.

15. Contactor according to claim 1, characterized by the fact that it is used for the placing in electric series of at least two electrochemical elements which generate electric current, said elements being connected by a common electrolyte.

16. A process which consists in making or breaking an electric contact between at least two fixed studs by means of at least one movable stud which moves under the action of at least one membrane which can deform under the action of a fluid, the displacement being obtained by fastening the movable stud to the membrane in such a manner that the movable stud is isolated from the two fixed studs in position of rest, characterized by the following features:

(a) the membrane comprises the following two parts:
at least one substantially nondeformable base to which the movable stud is fastened; and
flanks which are elastic with respect to the base and firmly attached to the base, the deformation of the membrane being obtained substantially solely by stretching of the flanks, this deformation causing a displacement of the base and therefore a displacement of the movable stud;

(b) the return of the membrane to its position of rest being obtained substantially solely by the elasticity of the flanks;

(c) the base and the flanks define at least one cavity in which is arranged at least in part a membrane holder; the corresponding fixed and movable studs being located on the outside of this cavity;

(d) means are provided for introducing the fluid between the membrane and the membrane holder or for evacuating the fluid from between the membrane and the membrane holder;

(e) the base being in contact with the membrane holder only in its position of rest; and (f) the membrane holder being capable of guiding the flanks during the deformation of the membrane.

* * * * *

UNITED STATES PATENT AND TRADEMARK OFFICE

CERTIFICATE OF CORRECTION

PATENT NO. : 4,239,979

DATED : December 16, 1980

INVENTOR(S) : Maurice Chapuis et al

It is certified that error appears in the above—identified patent and that said Letters Patent is hereby corrected as shown below:

First page, Item [30], "May 12, 1977" should read -- Dec. 5, 1977 --. Col. 3, line 8, "genertor" should read -- generator --. Col. 5, line 1, "assemly" should read -- assembly --. Col. 8, line 20, "5g" should read -- 59 --. Col. 9, line 25, "taken" should read -- then --.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*